US007470216B2

(12) United States Patent
Farinelli et al.

(10) Patent No.: US 7,470,216 B2
(45) Date of Patent: Dec. 30, 2008

(54) EXERCISE INTRA-REPETITION ASSESSMENT SYSTEM

(75) Inventors: Edward John Farinelli, Fort Collins, CO (US); Kenneth Joseph Sharkey, Fort Collins, CO (US)

(73) Assignee: Medaview Products LLC, Fort Collins, CO (US)

( * ) Notice: Subject to any disclaimer, the term of this patent is extended or adjusted under 35 U.S.C. 154(b) by 190 days.

(21) Appl. No.: 11/436,164

(22) Filed: May 17, 2006

(65) Prior Publication Data

US 2006/0264299 A1 Nov. 23, 2006

Related U.S. Application Data

(60) Provisional application No. 60/682,330, filed on May 17, 2005.

(51) Int. Cl.
*A63B 71/00* (2006.01)

(52) U.S. Cl. ..... 482/3; 482/4; 482/6; 482/7; 482/8; 482/9; 482/93

(58) Field of Classification Search ..... 482/3–9, 482/92–109, 902
See application file for complete search history.

(56) References Cited

U.S. PATENT DOCUMENTS

| | | | | |
|---|---|---|---|---|
| 4,063,726 | A | 12/1977 | Wilson | |
| 4,408,183 | A * | 10/1983 | Wills | 340/323 R |
| 4,674,741 | A * | 6/1987 | Pasierb et al. | 482/72 |
| 4,828,257 | A * | 5/1989 | Dyer et al. | 482/5 |
| 4,842,266 | A | 6/1989 | Sweeney | |
| 4,907,795 | A * | 3/1990 | Shaw et al. | 482/9 |
| 4,919,418 | A * | 4/1990 | Miller | 482/6 |
| 5,054,774 | A | 10/1991 | Belsito | |
| 5,149,084 | A * | 9/1992 | Dalebout et al. | 482/3 |
| 5,230,672 | A | 7/1993 | Brown | |
| 5,331,851 | A | 7/1994 | Parviainen | |
| 5,478,295 | A * | 12/1995 | Fracchia | 482/7 |
| 5,655,997 | A * | 8/1997 | Greenberg et al. | 482/5 |
| 5,715,160 | A | 2/1998 | Plotke | |
| 5,785,632 | A * | 7/1998 | Greenberg et al. | 482/5 |
| 6,165,105 | A * | 12/2000 | Boutellier et al. | 482/13 |
| 6,251,048 | B1 * | 6/2001 | Kaufman | 482/8 |
| 6,358,188 | B1 * | 3/2002 | Ben-Yehuda et al. | 482/8 |
| 6,601,016 | B1 | 7/2003 | Brown et al. | |

(Continued)

FOREIGN PATENT DOCUMENTS

| | | |
|---|---|---|
| EP | 0135346 | 3/1985 |

OTHER PUBLICATIONS

Weight lifting routines that build muscle . . . From the beginner to the advanced, May 11, 2005, building-muscle101.com, http://www.building-muscle101.com/weight-lifting-routines.html.*

(Continued)

*Primary Examiner*—Fenn C Mathew
*Assistant Examiner*—Andrew M Tecco
(74) *Attorney, Agent, or Firm*—Craig Miles; CR Miles, P.C.

(57) ABSTRACT

An intra-repetition exercise system which allows comparison of actual performance of intra-repetition exercise characteristics (2) to pre-established target performance of intra-repetition exercise characteristics (3) by an exerciser (1).

12 Claims, 9 Drawing Sheets

U.S. PATENT DOCUMENTS 6,632,158 B1 10/2003 Nashner
6,645,126 B1 11/2003 Martin et al.
6,656,091 B1 12/2003 Abelbeck
6,736,759 B1 5/2004 Stubbs et al.
6,740,007 B2 5/2004 Gordon
6,746,371 B1 6/2004 Brown
7,097,588 B2 * 8/2006 Watterson et al. ..... 482/8
2004/0224822 A1 * 11/2004 Verheem ..... 482/8
2005/0181918 A1 * 8/2005 Sumners et al. ..... 482/148

OTHER PUBLICATIONS

U.S. Appl. No. 60/682,330, entitled "Exercise Intra-Repetition Speed Indicator System", filed May 17, 2005.

* cited by examiner

EXERCISE INTRA-REPETITION ASSESSMENT SYSTEM

This International Patent Cooperation Treaty Patent Application claims the benefit of U.S. Provisional Patent Application No. 60/682,330, filed May 17, 2005, hereby incorporated by reference herein.

BACKGROUND

In general, an intra-repetition exercise system which allows comparison of actual performance of intra-repetition exercise characteristics to pre-established target performance of intra-repetition exercise characteristics by an exerciser. In specific, an intra-repetition exercise system which compares a pre-established target performance of intra-repetition speed of an exercise to actual performance of intra-repetition speed of an exercise.

Conventional exercise is typically performed as repetitions of anatomical movement by an exerciser to affect or assess physical condition. Each repetition of anatomical movement can be typically broken down into two phases (although certain exercises may comprise additional discrete phases). A first phase in which a portion of the exerciser's anatomy travels a distance away from a first location along an exercise travel path and a second phase in which that portion of the exerciser's anatomy travels to return to the first location, whether along the same exercise travel path or a different exercise travel path, each of the travel paths of the equal or unequal distance, to complete a repetition of anatomical movement for the exercise which may be referred to as an exercise repetition.

An amount of force can act directly or indirectly on the exerciser's anatomy to assist or resist travel of the exerciser's anatomy, in part or in whole, in either of the first phase or the second phase, or both the first phase and the second phase, or any increment, portion, or duration of time of an exercise repetition. As to certain exercise repetitions, the amount of force which acts to assist or resist travel of the exerciser's anatomy may remain consistent through out the first phase and the second phase, while as to other exercise repetitions it may variably adjust between the first phase and the second phase or within the first phase or the second phase. The level and application of the amount of force (whether consistent or variable) may further be dependent on numerous factors which may include without limitation the phase of the exercise repetition, the direction of travel within the phase of the exercise repetition, the location of the exerciser's anatomy in the exercise travel path of the exercise repetition, the amount of force generated by the exerciser's anatomy in the direction of travel in the exercise travel path, the amount of mass or weight opposed by the exerciser's exertion of force, the condition of the exerciser's anatomy (whether in whole or in part) exercised during the exercise repetition, or the evaluation, assessment, or other analysis parameters utilized to characterize the condition of the exerciser's anatomy (whether in whole or in part), or the like.

The exercise repetition also occurs in a time duration which may be fixed or variable and as between the first phase of an exercise repetition and the second phase of an exercise repetition the phases may be of equal or unequal time duration. Similarly, any increment of travel of the exerciser's anatomy in the travel path of the first phase of an exercise repetition or the second phase of an exercise repetition can occur in a time duration which may be fixed or variable. The time duration in which an exercise repetition, a phase of an exercise repetition, or any increment of travel of the exerciser's anatomy along the travel path of a phase of an exercise repetition, occurs may be further dependent on, adjusted in relation to, or adjusted by a factor which relates to, the amount of force acting on the exerciser's anatomy, in whole or in part, to assist or resist travel of the exerciser's anatomy, as above-described.

The exercise repetition can further include a conventional exercise device responsive to the exerciser or exerciser's anatomy, whether in whole or in part. The conventional exercise device can act to characterize the exercise repetition by establishing the direction and distance of the exercise travel path along which the exerciser's anatomy can travel and the amount of force which assists or resists travel of the exerciser's anatomy along the exercise travel path in both the first phase and second phase of the exercise repetition.

A wide variety of conventional exercise devices exist which allow the exerciser to select an amount of weight in a weight stack made responsive to the travel of the exerciser's anatomy in the exercise travel path of the first phase and of the second phase of the exercise repetition through a system of levers, pulleys, and other mechanical hardware which correspondingly elevates and lowers the amount of weight selected. These conventional weight stack exercise devices can further include a weight sensor for determining the number weights lifted and the direction of travel of the weights as described by U.S. Pat. No. 5,785,632 to Greenberg et al.

As conventional exercise devices evolved, adjustable hydraulic pistons and cylinders have been included to make a variably adjustable amount of resistive force responsive to the exerciser's anatomy in the travel path of the exercise repetition as describe for example by U.S. Pat. No. 4,063,726 to Wilson and European Patent Application No. 0,135,346 to Wu. Other conventional exercise devices also include drive mechanisms which provide isokinetic exercise reciprocating between concentric and eccentric modes as described by U.S. Pat. No. 4,919,418 to Miller and U.S. Pat. No. 5,230,672 to Brown et al.

These above-identified conventional exercise devices may further include a computer which allows the exerciser to further control the operation of these various exercise devices to select or adjust exercise protocols or programs. For example, exercise information generated from each exercise session can be stored to allow the exerciser to select an exercise protocol from those previously performed as described by U.S. Pat. No. 5,054,774. Similarly, stored exercise information from each exercise session can be used to provide the exerciser with a new exercise protocol for the next exercise session as described by U.S. Pat. No. 6,656,091 to Abelbeck et al. Alternately, as described by U.S. Pat. No. 6,740,007 to Gordon, a plurality of different measurements can be input to a computer to generate a customized exercise program for the exerciser.

The exercise information generated during each exercise session can also be processed by the computer to provide the exerciser with feedback about the percentage of total exercise effort achieved. As described by U.S. Pat. No. 4,842,266 to Sweeney a running machine provides a display of an oval track representing current position and percentage completion of effort. Similarly, exercise total repetitions completed can be graphically displayed as a proportional piece of a total scale provided, or the actual elapsed time duration can be graphically displayed as a proportional piece of total time duration, or both, as described by U.S. Pat. No. 4,408,183.

Actual overall exercise pace can also be displayed relative to a target overall exercise pace as described by U.S. Pat. No. 5,149,084 in which a fictitious competitor icon represents the overall target pace and a second icon represents the exerciser's prior overall pace. When the exerciser's overall pace is slower or more faster than the overall prior target pace, the exerciser icon moves behind or ahead of the target icon. Another pace device provides a pacing signal on a monitor screen and the exerciser follows the pacing signal to duplicate his previous performance as described by U.S. Pat. No. 4,907,795.

As can be understood from the above-description, it appears that a variety of conventional exercise devices teach provision of feedback to the exerciser of prior exercise performance to allow the selection or generation of subsequent exercise protocols or to provide pacing of an overall exercise session. Surprisingly, however, it appears that no conventional exercise device teaches the provision of feedback concerning intra-repetition performance by the exerciser (whether discrete from or combined with feed back concerning inter-repetition or overall performance). Even though the first phase and the second phase of a single exercise repetition, as described above, can be and has become increasingly complex to achieve, enhance, or assess the benefit of certain anatomical movements of the exerciser in the first phase or in the second phase of a single exercise repetition, or both, and even though these complex intra-repetition exercise characteristics may have been reduced to application by certain conventional exercise devices, some of which are above-described, there appears that no exercise device that teaches pre-establishing target performance of intra-repetition exercise characteristics or determining actual performance of intra-repetition exercise characteristics, or comparison of pre-established target performance of intra-repetition exercise characteristics to actual performance of intra-repetition exercise characteristics (discrete or apart from inter-repetition or overall exercise characteristics) by the exerciser.

Specifically, with respect to conventional exercise devices (including without limitation conventional rehabilitation or muscle condition assessment exercise devices) responsive to travel of an exerciser's anatomy, in whole or in part, to assess or affect physical condition there appears to be no conventional exercise device which teaches acquisition of intra-repetition exercise characteristics of either the first phase or second phase (or additional phases as may be defined for the travel path of the exercise), or both (or all), of an exercise repetition by a memory element of a computer; or teaches retrieval of intra-repetition characteristics of either the first phase or the second phase, or both, of an exercise repetition prior performed by an exerciser from a memory element of a computer; or teaches analysis, assessment, or graphically display of the intra-repetition characteristics of the first phase or the second phase, or both, of an exercise repetition to an exerciser; or teaches graphically displaying intra-repetition characteristics discrete to the first phase or the second phase, or both, of an exercise repetition as an exerciser performs the exercise repetition; or teaches comparing intra-repetition characteristics (whether input to or acquired by a memory element of a computer during prior performance by an exerciser) of the first phase or the second phase, or both, of an exercise repetition to the intra-repetition characteristics of the first phase or the second phase, or both, of an exercise repetition performed by an exerciser; or teaches a graphical display of prior stored intra-repetition characteristics of the first phase or the second phase, or both, of an exercise repetition compared to a second display of intra-repetition characteristics of the first phase or the second phase, or both, of an exercise repetition as performed by an exerciser; or teaches a graphical display to allow comparison of an intra-repetition target pace and an exerciser's performed intra-repetition pace, whether after the exercise has been performed or as the exercise is being performed, in real time, or otherwise.

Additionally, with respect to conventional exercise devices (or more specifically conventional rehabilitation exercise or assessment devices) responsive to travel of an exerciser's anatomy, in whole or in part, to assess or affect physical condition there appears to be no teaching of a breath pacer or any device to pace breathing which generates or otherwise provides a breath in indicia (an indicator to breath in) or a breath out indicia (an indicator to breath out) (or any manner of indicia) sensorially perceivable to the exerciser by sight, sound, touch, or otherwise, which allows the exerciser to compare actual breathing in and breathing out during performance of an exercise to a pre-established breathing target pace. In particular, there appears to be no conventional exercise device which teaches provision of a breath in indicia coupled to a pre-established target duration of the first phase of an exercise and providing a breath out indicia coupled to a pre-established target duration of the second phase of an exercise (or the breath out indicia coupled to the pre-established target duration of the first phase of exercise and the breath in indicia coupled to the pre-established target duration of the second phase of the exercise).

To address the unresolved problems of conventional exercise devices above-described with regard to performing and assessing intra-repetition characteristics of one or more repetitions of an exercise in correspondence to the pre-established target performance of at least one intra-repetition exercise characteristic of an exercise to affect physical condition, or provide physical rehabilitation or other medical treatment to an exerciser, the instant invention provides numerous and varied exercise devices which allow analysis and storage of intra-repetition characteristics of exercise and of breathing for the preparation of exercise protocols, breathing protocols, or both independently or in combination, which can be compared by the exerciser, another person, or by application of software programs, against actual intra-repetition performance of the first phase and the second phase of an exercise.

SUMMARY OF THE INVENTION

Accordingly, a broad object of the invention can be to provide an intra-repetition exercise system which allows comparison of a pre-established target performance of at least one intra-repetition exercise characteristic to the actual performance of the at least one intra-repetition exercise characteristic.

Another broad object of the invention can be to provide sensor means to generate signals which correspond to exercise intra-repetition characteristics such as the first location of a movable portion of an exercise device at the start of the first phase, the second location of a moveable portion of an exercise device at the end of the first phase, travel of the movable portion of an exercise device about a rotation axis, the force exerted by the exerciser to support a mass or weight during the first phase or the second phase of an exercise, the rate of travel of the exercise device or the anatomy of an exerciser during the first or second phase of an exercise, or the like.

Another broad object of the invention can be to provide computer hardware means computer networking means, or program application means to which signals can be applied to generate assessment of exercise intra-repetition characteristics including, but not limited to, the first location of the movable portion of the exercise device, the second location of the exercise device, the location of the movable portion of the exercise device in the travel path of the first phase or the second phase of an exercise, the force exerted by the exerciser during the first phase or the second phase of an exercise, a comparison of predetermined intra-repetition exercise characteristics in the first phase or the second phase of an exercise, or both, to the actual performed exercise characteristics in the first phase or the second phase, or both, of an exercise.

Another broad object of the invention can be to provide sensorially perceivable indicia of actual performance of exercise intra-repetition characteristics such as graphical display of actual performance of intra-repetition performance characteristics of an exercise in the first phase or the second phase of exercise which can be viewed by the exerciser.

Another broad object of the invention can be to provide sensorially perceivable indicia of target intra-repetition characteristics such as a graphical display which can be viewed by the exerciser to compare actual exercise intra-repetition performance characteristics with target intra-repetition performance characteristics.

Another broad object of the invention can be to provide sensorially perceivable indicia of target inter-repetition breathing characteristics such as a graphical display of a breath condition image which alternates between a breath in condition image and a breath out condition image with such alternation between the two conditions independent of or coupled to the alternation between the first phase and the second phase of the exercise or the respectively coupled to the duration of the first phase and the second phase of the exercise.

Naturally, further objects of the invention are disclosed throughout other areas of the specification, drawings, photographs, and claims.

A BRIEF DESCRIPTION OF THE DRAWINGS

FIG. 1 provides an illustration of an embodiment of the invention showing the first phase of an exercise.

FIG. 2 provides an illustration of an embodiment of the invention showing the second phase of an exercise.

FIG. 3 provides an illustration of another embodiment of the invention showing the first phase of an exercise.

FIG. 4 provides an illustration of another embodiment of the invention showing the second phase of an exercise.

FIG. 5 provides a block diagram of a computer hardware means and a computer network means which can be used in conjunction with an intra-repetition application software coupled to an exercise device to practice various embodiments of the invention.

FIG. 6 shows an embodiment of an intra-repetition performance indicator image generated using the intra-repetition application software which in part includes a target indicator field in which a target indicia travels, an actual performance indicator field in which a actual performance indicia travels, and a breath pacer (area decreased to show start of breath in condition) which allow pre-established target performance and actual performance of exercise and breathing intra-repetition characteristics to be compared.

FIG. 7 shows an embodiment of an intra-repetition performance indicator image generated using the intra-repetition application software which in part includes a target indicator field in which a target indicia travels, an actual performance indicator field in which a actual performance indicia travels, and a breath pacer (area increased to show start of breath out condition) which allow pre-established target performance and actual performance of exercise and breathing intra-repetition characteristics to be compared.

FIG. 8 shows an embodiment of an intra-repetition performance indicator image which provides a target indicia which travels in a target indicator field and an actual performance indicia which travels in an actual performance indicator field configured to allow comparison of pre-established target performance of intra-repetition exercise characteristics and actual performance of intra-repetition exercise characteristics prior to the start of an exercise repetition.

Figure 13:
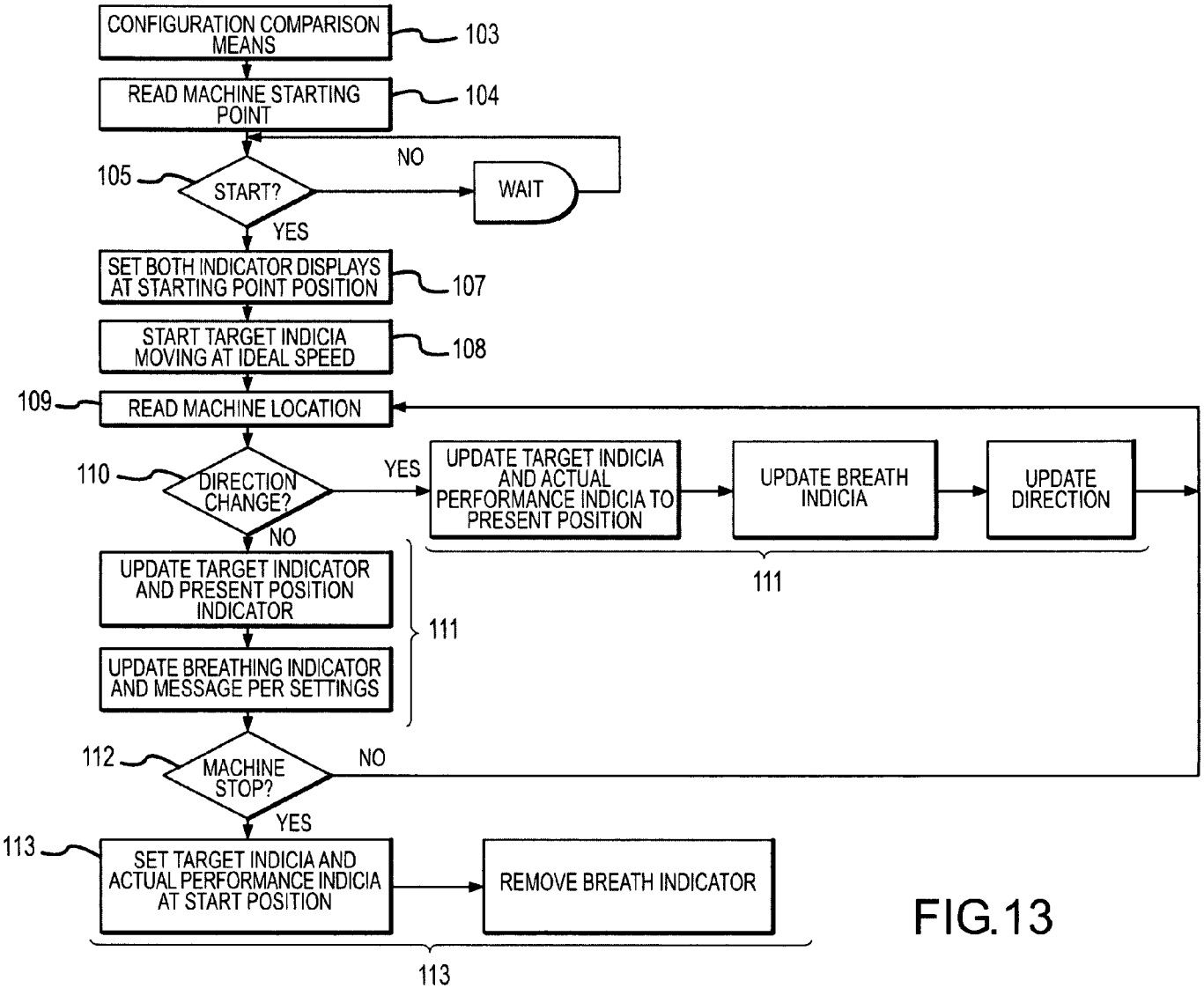

FIG. 13 provides a flow diagram of the steps of a particular embodiment of the invention to allow comparison of actual intra-repetition performance with target intra-repetition performance of an exercise.

DETAILED DESCRIPTION OF THE PREFERRED EMBODIMENTS

According to various embodiments of the invention, the shortcomings of the prior art are addressed by providing an exercise intra-repetition performance assessment system which allows an exerciser to compare actual performance of at least one intra-repetition exercise characteristic to a pre-established (or pre-selected) target performance of that at least one exercise characteristic. In specific, an intra-repetition exercise speed indicator which graphically compares an actually performed speed with a pre-established target speed for the first phase, the second phase, or both phases of an exercise.

The present invention may be described herein in terms of functional block components, screen shots, optional selections and various processing steps. It should be appreciated that such functional blocks may be realized by any number of hardware or software components configured to perform the specified functions. For example, the present invention may employ various integrated circuit components which function without limitation as memory elements, processing elements, logic elements, look-up tables, or the like, which may carry out a variety of functions under the control of one or more microprocessors or other control devices.

Similarly, the software elements of the present invention may be implemented with any programming or scripting language such as C, C++, Java, COBOL, assembler, PERL, Labview or any graphical user interface programming language, extensible markup language (XML), Microsoft's Visual Studio .NET, Visual Basic, or the like, with the various algorithms or Boolean Logic being implemented with any combination of data structures, objects, processes, routines or other programming elements. Further, it should be noted that the present invention might employ any number of conventional techniques for data transmission, signaling, data processing, network control, and the like.

It should be appreciated that the particular implementations shown and described herein are illustrative of the invention and its best mode and are not intended to otherwise limit the scope of the present invention in any way. Indeed, for the sake of brevity, conventional data networking, application development and other functional aspects of the systems (and components of the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical electronic transaction system.

As will be appreciated by one of ordinary skill in the art, the present invention may be embodied as a method, a data processing system, a device for data processing, a computer program product. Accordingly, the present invention may take the form of an entirely software embodiment, an entirely hardware embodiment, or an embodiment combining aspects of both software and hardware. Furthermore, the present invention may take the form of a computer program product on a computer-readable storage medium having computer-readable program code means embodied in the storage medium. Any suitable computer-readable storage medium may be utilized, including hard disks, CD-ROM, optical storage devices, magnetic storage devices, ROM, flash RAM, and/or the like.

The present invention is described herein with reference to screen shots, block diagrams and flowchart illustrations of exercise methods, exercise apparatus, or computer program products which can be utilized separately or in combination with such exercise methods or exercise apparatus, or both, according to various aspects or embodiments of the invention. It will be understood that each functional block of the block diagrams and the flowchart illustrations, and combinations of functional blocks in the block diagrams and flowchart illustrations, respectively, can be implemented by computer program instructions. These computer program instructions may be loaded onto a general purpose computer, special purpose computer. or other programmable data processing apparatus to produce a machine, such that the instructions which execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions specified in the flowchart block or blocks.

Accordingly, functional blocks of the block diagrams and flowchart illustrations support combinations of means for performing the specified functions, combinations of steps for performing the specified functions, and program instruction means for performing the specified functions. It will also be understood that each functional block of the block diagrams and flowchart illustrations, and combinations of functional blocks in the block diagrams and flowchart illustrations, can be implemented by either special purpose hardware based computer systems which perform the specified functions or steps, or suitable combinations of special purpose hardware and computer instructions.

Figure 1:
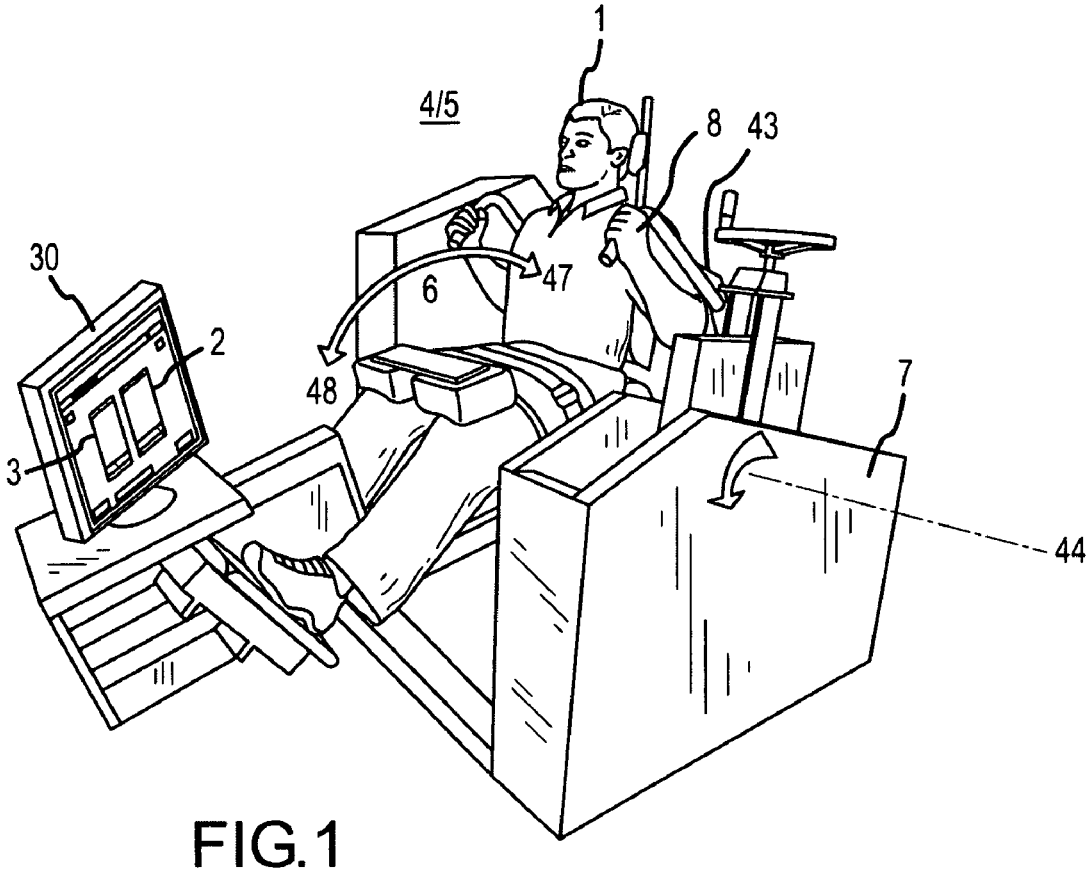
Figure 2:
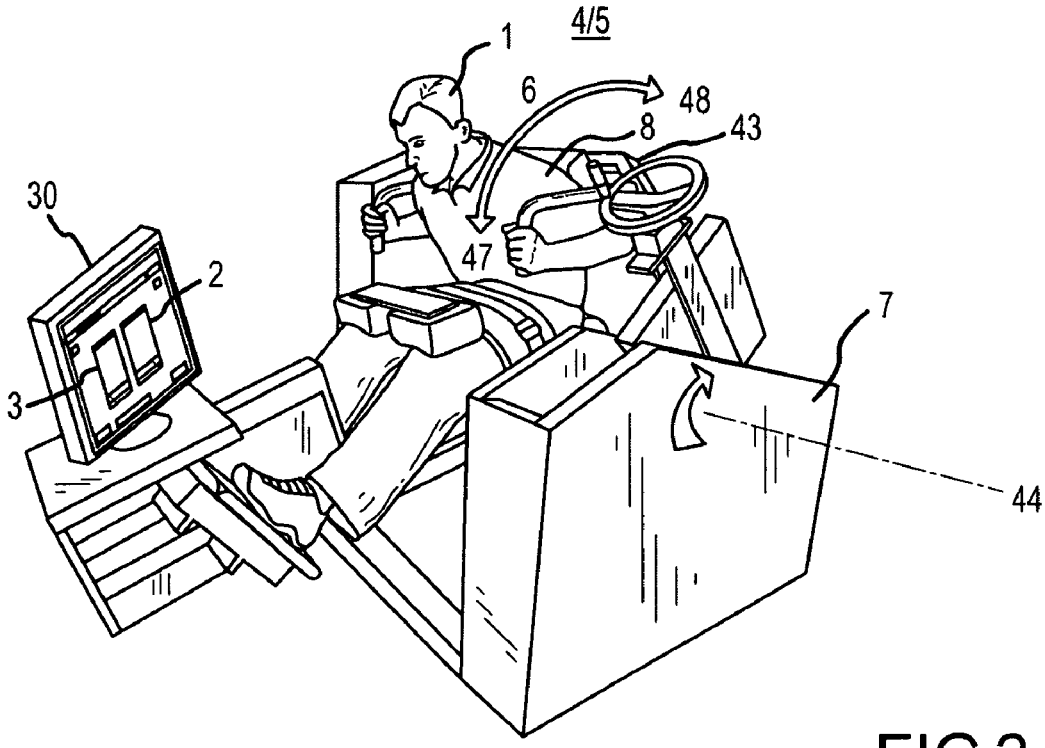
Figure 3:
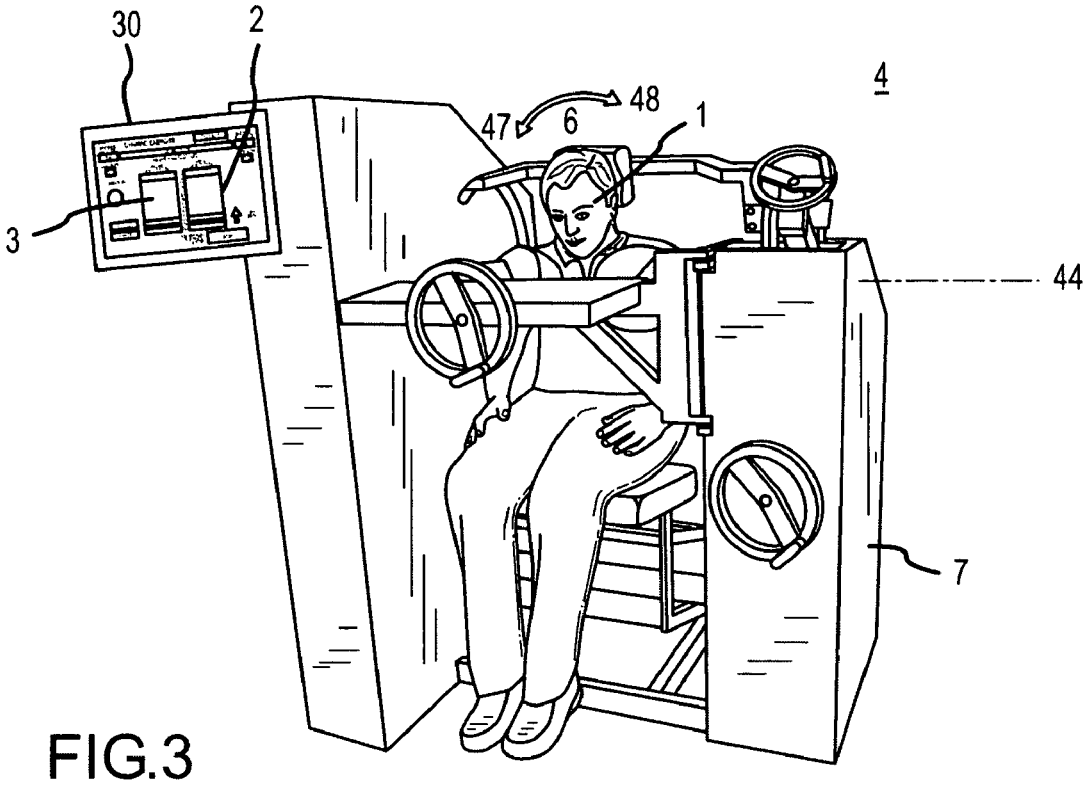
Figure 4:
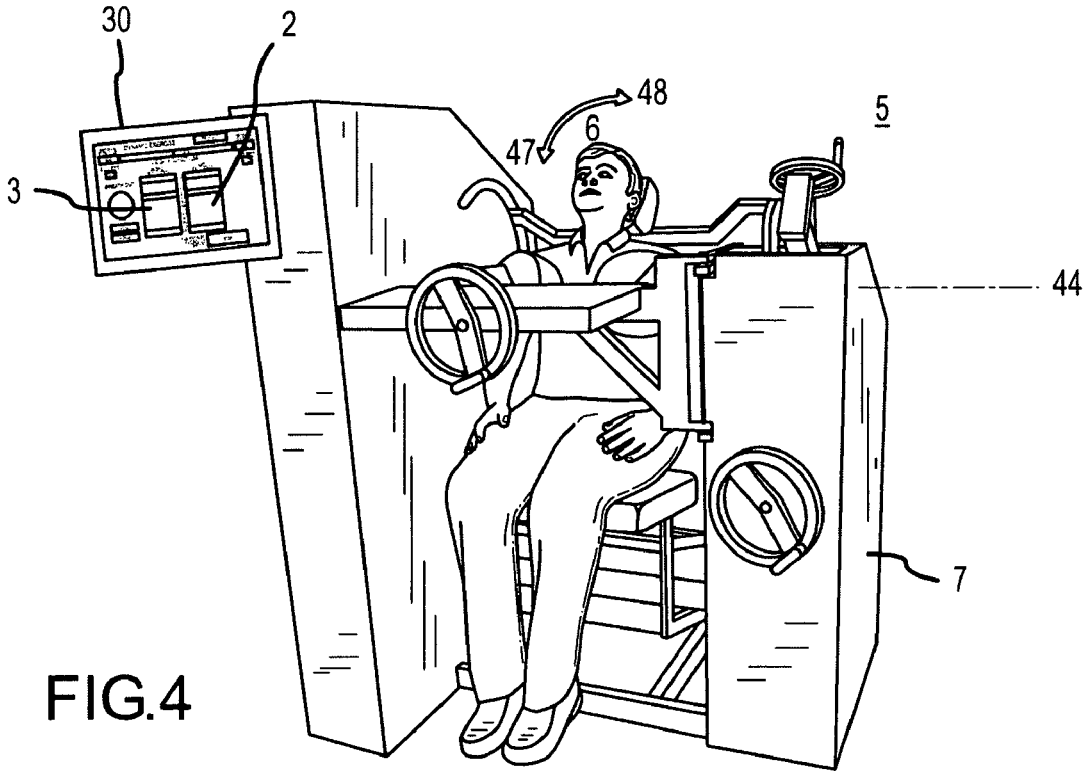

Now referring primarily to FIGS. 1-4, an exercise intra-repetition assessment system which can be used by an exerciser (1) to compare actual intra-repetition exercise characteristics (2)(a non-limiting example as graphically displayed in FIGS. 1 through 4) to pre-established intra-repetition exercise characteristics (3)(a non-limiting example as graphically displayed in FIGS. 1 through 4) of either a first phase (4)(as shown for example in FIG. 3) or a second phase (5)(as shown for example in FIG. 4)(or additional phases as may be defined for the travel path (6) of the exercise), or both (or all), of an exercise repetition. As shown in FIGS. 1 and 2 and in FIGS. 3 and 4, the movable portion (43) of each one of the exercise devices (7) responsive to a part of the exerciser (8) assists in defining the travel path (6) of the first phase (4) and the second phase (5) (or additional phases) of an exercise. As shown in FIGS. 1 and 2, on example of a particular exercise device (7) assists in defining the travel path of an exercise (6) which depending on how resistance is applied to travel of the moveable portion (43) in the travel path of the exercise (6) primarily affects the lumbar muscles of the backside or the abdominal muscles of the front side of the exerciser (1). As shown by FIGS. 3 and 4, another example of a particular exercise device (7) assists in defining the travel path (6) of an exercise which primarily affects the neck muscles.

The term "exercise device" (7) is intended to broadly encompass any apparatus, equipment, machine, or the like, which can be made responsive to the anatomy (8) of an exerciser (1) and without limitation includes devices which allow the exerciser to select an amount of weight in a weight stack made responsive to the travel of the exerciser's anatomy through a system of levers, pulleys, and other mechanical hardware which correspondingly lifts and lowers the amount of weight selected as manufactured for example by IRONMAN®, UNIVERSAL FITNESS®, BODYCRAFT®, NAUTILUS®, or the like; or devices, apparatuses, or exercise systems which allow the exerciser to select an amount of resistance whether static dynamic or variable regardless as to how such amount of resistance is generated; or devices or exercise systems used for quantitative clinical testing, assessment or rehabilitation of comprehensive body condition or specific muscle or movement condition, whether preventative, post-surgery or post-injury, or the like, for example as described by U.S. Pat. No. 4,919,418 to Miller; or as described by or similar to the above-referenced United States patents, or for example the Lumbar Extension Machine as distributed by MedX, 4820 Newberry Road, Gainesville, Fla.

The term "exerciser" (1) is intended to encompass any person or animal which utilizes a device as above-described (or otherwise) whether to evaluate, affect, rehabilitate, improve or treat a condition of such person's or animal's body or anatomy in general; or as to a specific system; or part, portion, or component of such body or anatomy; or particular muscle, joint, or nerve of such body or anatomy; or to affect the travel or motion, range of travel or motion, speed of such travel or motion, or other characteristic of such body or anatomy.

The term "responsive to a part of the exerciser" is intended to broadly encompass any part of the exerciser (1) engaged to any part of exercise device (7) regardless of the part or portion of the exerciser's (1) anatomy engaged and regardless of the part or portion of the exercise device (7) engaged which allows use of the exercise device (7) by the exerciser (1).

The term "exercise" means travel of an exerciser's (1) body, or a part thereof, within the range of travel defined by engagement of the exerciser's body (1) to an exercise device (7) (the "travel path of the exercise device") to evaluate, affect, rehabilitate, improve or treat the condition of an exerciser; whether as to a specific system; or part, portion, or component of the body or anatomy; or particular muscle, joint, or nerve of such body or anatomy; or to affect the travel or motion, range of travel or motion, speed of such travel or motion, or other characteristic of the body or anatomy of the exerciser.

The term "exercise repetition" means a basic unit of exercise defined by travel of the exerciser's (1) body in the travel path of the exercise device (6) from a first location in the travel path of the exercise device (6) to a second location (or more locations) in the travel path of the exercise device (6) and a return to the first location in the travel path of the exercise device (6). The exerciser may repeat the basic unit of exercise as many times as necessary to evaluate, affect, rehabilitate, improve or treat the condition of an exerciser; whether as to a specific system; or part, portion, or component of the body or anatomy; or particular muscle, joint, or nerve of such body or anatomy; or to affect the travel or motion, range of travel or motion, speed of such travel or motion, or other characteristic of the body or anatomy of the exerciser.

The term "intra-repetition" means within the duration of one discrete exercise repetition of an exercise being assessed with regard to any pre-established target performance or actual performance of the exercise repetition or any exercise characteristic of the exercise repetition and specifically excludes pre-established target performance or actual performance of the exercise repetition or any exercise characteristic of the exercise repetition derived from assessment (such as averaging) of pre-established or actual performance of a plurality of exercise repetitions or derived from assessment of inter-repetition performance (outside the duration of the one discrete exercise repetition being assessed).

The term "intra-repetition exercise characteristic" is intended to broadly encompass within the duration of one discrete exercise repetition any measurable event relating to the exerciser's anatomy or the moveable part (43) of the exercise device (7) as it travels in the first phase (4) or the second phase (5) of an exercise repetition which can be including without limitation: the first location (47), direction of travel toward the second location (48), the amount of force exerted by the exerciser's anatomy during any increment of travel toward the second location (48), the speed of any increment of travel toward the second location (48), the second location (48), the direction of travel toward the first location (47), the amount of force exerted by the exerciser's anatomy during any increment of travel toward the first location (47), the range of anatomical motion during performance of the first phase (4) or the second phase (5) of an exercise repetition regardless of the units of measure, or the like.

The term "first phase" means travel of the exerciser's body or anatomy, or part or portion thereof, coupled to the exercise device as above-described which begins at a first location in the travel path of the exercise device (6) and ends at a second location in the travel path of the exercise device.

The term "second phase" means travel of the exerciser's body or anatomy, or part or portion thereof, coupled to the exercise device as above-described which begins at the second location in the travel path of the exercise device (6) and ends at the first location in the travel path of the exercise device.

Referring primarily to FIGS. 1-2, the first phase (4) of an exercise can begin with the exerciser (1) in the position as shown in either of FIG. 1 or 2 depending on the exercise. For example, with respect to an exerciser (1) exerting force by contraction of the abdominal muscles the first phase (4) of the exercise generates travel from a first location (47) to a second location (48) in the travel path of the exercise device (6) as shown by FIG. 1. Alternately, with respect to an exerciser (1) exerting force by contraction of the back muscles the first phase (4) of the exercise comprises travel from a first location (47) to a second location (48) in the travel path of a similar exercise device as shown by FIG. 2. The second phase (5) of the exercise comprises travel from the second location (48) back to the first location (47) in the travel path of the exercise device (6). Travel from the first location (47) to the second location (48) and back to the first location (47) comprises one repetition of the exercise and intra-repetition within the one repetition of the exercise. As such, the intra-repetition exercise characteristics are those characteristics of the exercise which occur in the first phase (4) or the second phase (5) of the repetition of exercise such as travel distance in the first phase, travel distance in the second phase, duration of the first phase, duration of the second phase, speed of travel in the first phase, speed of travel in the second phase, degrees of rotation about a rotation axis (44) of the exercise device in the first phase (4), degrees of rotation about a rotation axis (44) of the exercise device in the second phase (5), or the like.

Referring primarily to FIGS. 3 and 4, the first phase (4) of an exercise can begin with the exerciser (1) in the position as shown in FIG. 3. With respect to the particular exercise shown in FIGS. 3 and 4, contraction of the neck muscles in the first phase (4) of the exercise generates travel from the first location (47) to the second location (48) in the travel path of the exercise device (6). Extension of the neck muscles in the second phase (5) of the exercise generates travel from the second location (48) back to the first location (47) in the travel path of the exercise device (6) which comprises one repetition of the particular exercise which includes the particular intra-repetition exercise characteristics, such as above-described.

Figure 5:
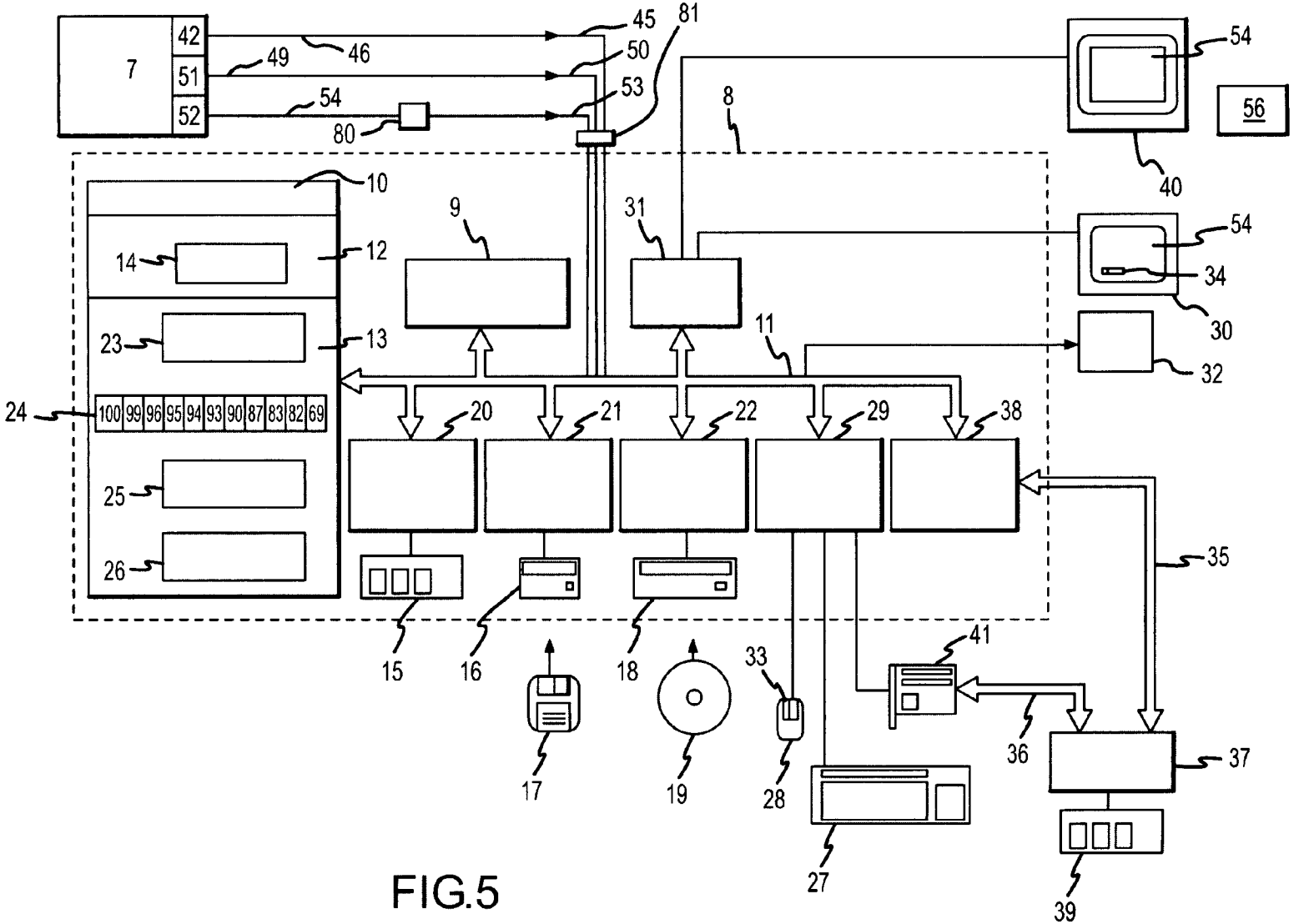

Now referring primarily to FIG. 5, which shows a block diagram of a non-limiting embodiment of the invention. An exercise device (7) as above-described can be coupled to a a first computer (8) having at least one processing unit (9), a memory element (10), and a bus (11) which operably couples components of the computer (8), including without limitation the memory element (10) to the processing unit (9). The computer (8) may be a conventional computer, a distributed computer, or any other type of computer; the invention is not so limited. The processing unit (9) can comprise one central-processing unit (CPU), or a plurality of processing units which operate in parallel to process digital information. The bus (11) may be any of several types of bus configurations including a memory bus or memory controller, a peripheral bus, and a local bus using any of a variety of bus architectures. The memory element (10) can without limitation be a read only memory (ROM) (12) or a random access memory (RAM) (13), or both. A basic input/output system (BIOS) (14), containing routines that assist transfer of data between the components of the computer (8), such as during start-up, can be stored in ROM (12). The computer (8) can further include a hard disk drive (15) for reading from and writing to a hard disk (not shown) a magnetic disk drive (16) for reading from or writing to a removable magnetic disk (17), and an optical disk drive (18) for reading from or writing to a removable optical disk (19) such as a CD ROM or other optical media.

The hard disk drive (15), magnetic disk drive (16), and optical disk drive (18) are connected to the bus (11) by a hard disk drive interface (20), a magnetic disk drive interface (21), and an optical disk drive interface (22), respectively. The drives and their associated computer-readable media provide nonvolatile storage of computer-readable instructions, data structures, program modules and other data for the computer (8). It can be appreciated by those skilled in the art that any type of computer-readable media that can store data that is accessible by a computer, such as magnetic cassettes, flash memory cards, digital video disks, Bernoulli cartridges, random access memories (RAMs), read only memories (ROMs), and the like, may be used in the exemplary operating environment.

A number of exercise intra-repetition software application modules (24) along with a plurality of other application programs (25) may be stored on the hard disk, magnetic disk (17), optical disk (19), ROM (12), or RAM (13), along with an operating system (23), one or a plurality of other application programs (24), and exercise intra-repetition data and other program data (26). The computer user may enter commands and information into the computer (8) through input devices such as a keyboard (27) and pointing device such as a mouse (28). Other input devices (not shown) may include a microphone, joystick, game pad, satellite dish, scanner, or the like. These and other input devices are often connected to the processing unit (9) through a serial port interface (29) that can be coupled to the bus (11), but may be connected by other interfaces, such as a parallel port, game port, or a universal serial bus (USB). A first monitor (30) and a second monitor (40) or other type of display device can also be connected to the bus (11) via interfaces such as a video adapter (31), or the like. In addition to the monitor (30), the computer (8) can further include other peripheral output devices (32), such as speakers and printers.

A "click event" occurs when the user operates an application function through the use of a command which for example can include pressing or releasing the left mouse button (33) while a pointer is located over a control icon (34) displayed by the monitor (30). However, it is not intended that a "click event" be limited to the press and release of the left button (33) on a mouse (28) while a pointer is located over a control icon (34), rather, "click event" is intend to broadly encompass a command by the user through which a function of an application program (24) or of other program module (25) is activated or performed, whether through selection of one or a plurality of control icon(s) (34) or by user voice command, keyboard (27) stroke, mouse button (33), touch screen, or otherwise. It is further intended that control icons (31) can be configured without limitation as a point, a circle, a triangle, a square (or other geometric configurations or combinations or permutations thereof), or as an information field which can contain addresses such as a street address, zip code, county code, or natural area code, or inputting a latitude/longitude or projected coordinate X and Y, or other notation, script or character, or the like.

The first computer (8) may operate in a networked environment using logical connections (35)(36) to one or a plurality of second computers (37). These logical connections (35)(36) are achieved by a communication device (38) coupled to or a part of the computer (8); the invention is not limited to a particular type of communications device (38). The second computer (37) may be another computer, a server, a router, a network PC, a client, a peer device or other common network node, and can include a part or all of the elements above-described relative to the computer (8), although only a memory storage element (39) has been illustrated in FIG. 4. The logical connections (35)(36) depicted in FIG. 4 can include a local-area network (LAN) (35) or a wide-area network (WAN) (36). Such networking environments are commonplace in offices, enterprise-wide computer networks, intranets and the Internet.

When used in a LAN-networking environment, the computer (8) can be connected to the local network (35) through a network interface or adapter (38), which is one type of communications device. When used in a WAN-networking environment, the computer (8) typically includes a modem (40), a type of communications device, or any other type of communications device for establishing communications over the wide area network (36), such as the Internet. The modem (41), which may be internal or external, is connected to the bus (11) via the serial port interface (29). In a networked environment, program modules depicted relative to the first computer (8), or portions thereof, may be stored in the second computer memory element (39). It is appreciated that the network connections shown are exemplary and other hardware means and communications means for establishing a communications link between computers (8)(37) can be used.

While the computer means and the network means shown in FIG. 5 can be utilized to practice preferred embodiments of the invention including the best mode, it is not intended that the description of the best mode of the invention or any preferred embodiment of the invention be limiting with respect to the utilization of a wide variety of similar, different, or equivalent computer means or network means to practice embodiments of the invention which include without limitation hand-held devices, such as personal digital assistants or camera/cell phone, multiprocessor systems, microprocessor-based or programmable consumer electronics, network PCs, minicomputers, mainframe computers, PLCs, or the like.

Again referring primarily to FIG. 5, the invention can further include a first sensor (42) responsive to travel of at least one moveable element (43) of the exercise device (7) in the first phase (4) or the second phase (5), or both, of an exercise. Travel of at least one moveable element (43) of the exercise device (7) can comprise rotation of the at least one moveable element (43) about a rotation axis (44) as exemplified by the travel of the non-limiting exercise device (7) shown in FIGS. 1-2 and FIGS. 3-4. In that example, the first sensor (42) can comprise a potentiometer (whether analog or digital) used to vary, or control, the amount of current that flows through an electronic circuit (45). The computer (8) can be made responsive, directly or indirectly, to the variance in the amount of current in the electronic circuit or other type of first sensor signal (45) to allow analysis and comparison of various characteristics relating to the travel of the at least one moveable element (43) about the rotation axis (44). The various characteristics can be initiation of travel by the at least one movable element (43), cessation of travel by the at least one moveable element (43), the arc length traveled by the at least one moveable element (43) whether in degrees or radians, the direction of travel by the at least one moveable element (43), the speed of travel of the at least one moveable element (43), acceleration or deceleration of travel by the at least one moveable element (43), or the like.

This example; however, is not intended to the limit the invention to any particular embodiment of a movable element (43) or the manner of sensing the travel of the movable element (43), either directly or indirectly, but rather is illustrative of the numerous and varied first sensors (42) which can be utilized to generate a first sensor signal (45) which can be analyzed by the computer (8) to characterize the travel of the movable element (43), as above described. Other types of sensors which may be utilized to generate a first sensor signal (45) relating to the travel of the movable element (43) whether in the first phase (4) or the second phase (5) of an exercise repetition can be an ultrasonic motion sensor or an infrared motion sensor each comprising an emitter, detector, optics, and timing logic can be used to generate a first sensor signal (45) comprising an analog voltage proportional to the distance to the moveable element (43) in the sensor's field of view.

Again referring to FIG. 5, the invention can further include a second sensor (51) responsive to the movable element (43) of the exercise device (7) which can sense a first location (47) corresponding to the start of travel (6) in the first phase (4) of an exercise repetition and can sense a second location (48) corresponding to the end of travel (6) in the first phase (4) of an exercise repetition. Naturally, the first location (47) and the second location (48) can vary depending on the pre-established target performance of the intra-repetition exercise characteristics set prior to start of the exercise repetition. As to a series of exercise repetitions, the first location (47) and the second location (48) of the first phase (4) of an exercise repetition can remain fixed or the first location (47) and the second location (48) can vary between repetitions of an exercise.

A preferred embodiment of the second sensor (51) can comprise a pair of optical break beam sensors each including at least an emitter and a detector used to vary, or control, the amount of current that flows through an electronic circuit (49) used to generate a second sensor signal (50) to which the computer (8) can be made responsive, directly or indirectly, to initiate analysis of various intra-repetition characteristics as above-described. This example; however, is not intended to the limit the invention to any particular embodiment of a second sensor (47) or the manner of sensing the first location (47) or the second location (48) of the movable element (43), either directly or indirectly, but rather is illustrative of the numerous and varied second sensors (47) which can be utilized to generate a second sensor signal (50) which can be received by the computer (8) to initiate analysis of the various intra-repetition characteristics of an exercise. Other types of sensors which may be utilized to generate a second sensor signal (50) relating to the first location (47) or the second location (48) whether in the first phase (4) or the second phase (5) of an exercise repetition can be a switch responsive to the movable element (43) at the first location (47) or at the second location (48), or both, of the first phase of an exercise repetition. Another preferred embodiment of the second sensor (51) which can be used separately or in combination with other embodiments of the second sensor (46) can he a click event performed by the exerciser or other person which corresponds to the first location (47) or the second location (48) of the first phase of an exercise repetition.

Again referring to FIG. 5, the invention can further include a third sensor (52) which can be used to generate a third sensor signal (53) corresponding to an amount of force exerted by the exerciser in supporting the weight or mass established by the exercise device at a particular location(s) in the first phase (47) or the second phase (48) of an exercise repetition. The third sensor signal (53) corresponding to the amount of force exerted by the exerciser can be received by the computer (8) and converted continuously or at intervals to a desired unit of measurement for the analysis of the various intra-repetition characteristics above-described.

A preferred embodiment of the third sensor (52) can comprise a S-type load cell having a first leg of the S configuration connected to the movable portion (43) of the exercise device (7) and a second leg of the S configuration connected to the mass or weight of the exercise device which can be used to vary, or control, the amount of current that flows through an electronic circuit (54) to provide the third sensor signal (53). Two suitable S-type load cells can be a Sensortronics Model 6001 as distributed by Intertechnology, 1 Scarsdale Road, Don Mills, Ontario, M3B 2R2 or a Model RSC 2K-2444 through HMB, Inc., 19 Barlett Street, Marlbourough, Mass. These examples; however, is not intended to the limit the invention to any particular embodiment of a third sensor (52) or the manner of sensing the force exerted by the exerciser to support or move the mass or weight coupled to the movable element (43), either directly or indirectly, but rather is illustrative of the numerous and varied third sensors (52) which can be utilized to generate a third sensor signal (53) which can be received by the computer (8) to for analysis of an amount of force exerted by the exerciser due to the intra-repetition characteristics of an exercise.

The invention can further include an analog to digital converter (81) which can be used to convert each of the first signal (45), the second signal (50), or the third signal (51) from an analog signal to a digital signal. An amplifier (80) can be further included to increase the magnitude of an analog signal prior to conversion from an analog signal to a digital signal.

Various embodiments of the intra-repetition software application (24) utilize the signals (45)(50)(53) from the first sensor (42), the second sensor (51), or the third sensor (52) (or other additional sensors), whether individually or in various combinations or permutations, to analyze an exerciser's performance of intra-repetition characteristics of an exercise. The intra-repetition characteristics which can analyzed utilizing the signals (45)(50)(53) from the various sensors (42)(51)(52)(or other additional sensors and signals) can include initiation of travel in the first phase (4), location of the exerciser's anatomy (8) in the travel path (6) of the first phase (4), increment of actual travel compared with total travel in the travel path (6) of the first phase, rate of travel in the first phase (4), amount of force affecting travel in the first phase (4), end of travel in the first phase (4), initiation of travel in the second phase (5), increment of actual travel compared with the total travel in the travel path (6) of the second phase, location of exerciser's anatomy (8) in the travel path (6) of the second phase (5), rate of travel in the second phase (5), amount of force affecting travel in the second phase (5), end of travel in the second phase (6), or the like.

Figure 6:
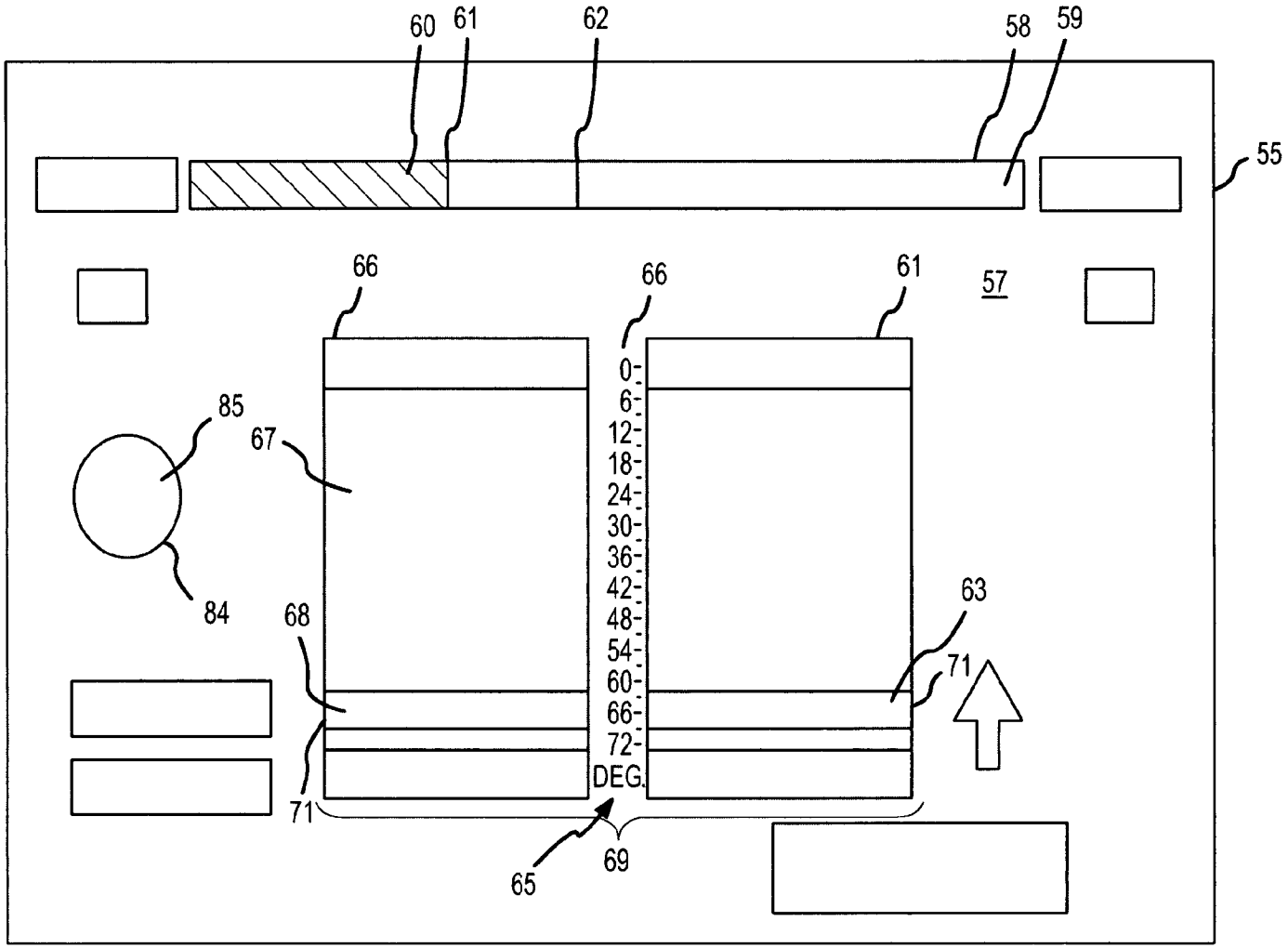

Now referring primarily to FIGS. 5 and 6, a intra-repetition performance indicator module (82) of the exercise intra-repetition software application (24) can generate at least one intra-repetition performance indicator image (55) which can be displayed on the monitor (30) perceivable by the exerciser (1) or a second monitor (40) perceivable by a second person (56) such as a trainer or a therapist. The at least one intra-repetition performance indicator image (55) can provide one or a plurality of intra-repetition performance indicators (57) which allow the exerciser to sensorially perceive pre-established target performance of at least one intra-repetition exercise characteristic or actual performance of at least one intra-repetition performance characteristic.

Now referring primarily to FIG. 6, a plurality of intra-repetition performance indicators (57) generated by the intra-repetition performance indicator module (82) of the exercise intra-repetition software application (24) can in part include an actual performance indicator (61) which provides an actual performance indicator field (62) which graphically represents the selected travel range of the moveable portion (43) of the exercise device (7). An actual performance indicia (63) travels in the actual performance indicator field (62) in correspondence with actual travel of the movable portion (43) of the exercise device (7) between the first location (47) to the second location (48) in the first phase (4) of an exercise repetition and from the second location (48) to the first location (47) in the second phase of an exercise repetition allowing the exerciser (1) to sensorially perceive the actual position of the movable portion (43) of the exercise device (7) in the travel range of the moveable portion (43) of the exercise device (7).

As to certain embodiments of the invention, the actual performance indicator (61) can further include a degree indicator (64) which provides a representation of the degrees of rotation about the rotation axis (44) through which the movable portion (43) of the exercise device (7) travels or the exerciser's anatomy (8) travels while engaged with exercise device (7) from the first location (47) to the second location (48). The degree indicator (64) can provide an adjustable degree scale (65) having the zero degree indication (66) adjusted in correspondence to alteration in degrees of rotation comprising the travel path (6) from the first location (47) to the second location (48) along which the moveable portion (43) of the exercise device travels.

Again referring primarily to FIGS. 5 and 6, the intra-repetition performance indicator module (82) of the exercise intra-repetition software application (24) can analyze signals (45)(50)(53)(or other signals) from the first sensor (42), the second sensor (51), and the third sensor (54)(or other sensors) to compare the exerciser's (1) actual performance of at least one intra-repetition characteristic (as above-described or otherwise) of an exercise to a target performance of at least one intra-repetition characteristic of an exercise. An intra-repetition target indicator (66) can provide a target indicator field (67) in which a target indicia (68) travels in correspondence to the target characteristics pre-established for intra-repetition performance of the first phase (4) and the second phase (5) of an exercise repetition. By further providing a comparison means (69) by which travel of the target indicia (68) in the target indicator field (67) can be compared to travel of the location indicia (63) in the travel range indicator field (62), the exerciser (1) can pace intra-repetition characteristics or intra-repetition events.

The comparison means (69) as shown by FIG. 6 can comprise graphically configuring the intra-repetition actual performance indicator (61) and intra-repetition target indicator (66) for direct visual comparison by the exerciser (1). The actual performance indicator field (62) and the target indicator field (67) can be configured as substantially identical images located adjacent to each other to allow direct visual comparison of travel of the actual performance indicia (63) and the target indicia (68). The actual performance indicia (63) and the target indicia (68) can also be configured as substantially identical images to further assist in direct visual comparison of actual performance with target performance of one or more intra-repetition exercise characteristics.

Now referring primarily to FIGS. 6-11, provide a non-limiting example of utilization of the intra-repetition target indicator and intra-repetition actual performance indicator to compare the pre-established target performance of intra-repetition exercise characteristics with the actual performance of intra-repetition exercise characteristics with regard to initiation of travel in the first phase (4), location of the exerciser's anatomy (8) in the travel path (6) of the first phase (4), increment of travel in the travel path (6) of the first phase, rate of travel in the first phase (4)(to allow pre-established target speed of each phase of an exercise to be compared with actual performance speed of each phase of one exercise repetition), degrees of rotation about the rotation axis (44) through which the movable portion (43) of the exercise device (7) travels in the first phase, end of travel in the first phase (4), initiation of travel in the second phase (5), increment of travel in the travel path (6) of the second phase, location of exerciser's anatomy (8) in the travel path (6) of the second phase (5), rate of travel in the second phase (5), degrees of rotation about the rotation axis (44) through which the movable portion (43) of the exercise device (7) travels in the second phase, and end of travel in the second phase (6).

Figure 8:
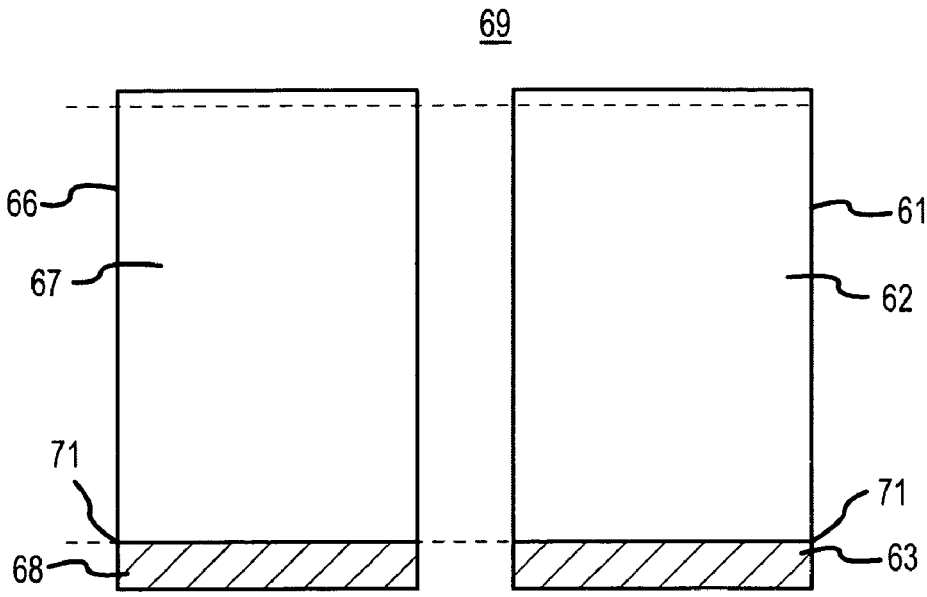
Figure 9:
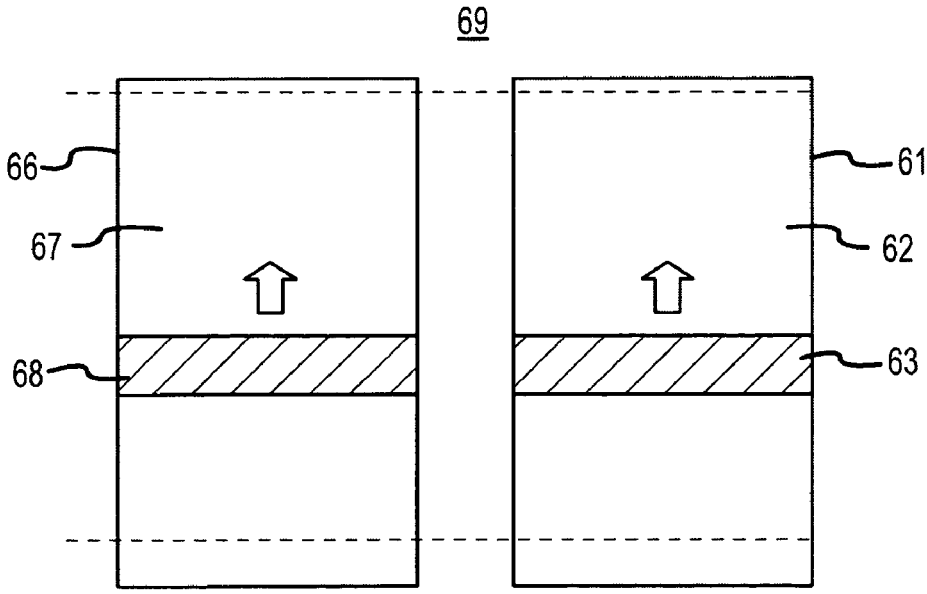
FIG. 9 shows an embodiment of the intra-repetition performance indicator image which indicates the actual performance of an intra-repetition exercise characteristic in the first phase of an exercise substantially compares to the pre-established target performance for the particular intra-repetition exercise characteristic.

As shown in FIG. 8, when the movable portion (43) of the exercise device (7) is at the first location (47) prior to initiating travel in the first phase (4) of the exercise the actual performance indicia (63) and the target indicia (68) are established at substantially the same location in their respective fields (62)(67). Then as shown in FIG. 9, upon initiation of the first phase (4) of the exercise, the target indicia (68) travels in the target indicator field (67) at a rate in correspondence to the pre-established target performance of the intra-repetition exercise characteristics of the first phase (4) of the exercise. The actual performance indicia (63) travels in the actual performance indicator field (62) at a rate in correspondence to the actual performance of the intra-repetition exercise characteristics of the exercise by the exerciser (1) (the embodiment of the invention shown provides a target indicator field and an actual performance indicator field in which the target indicia and the actual performance indicia travel in a first direction in the respective fields corresponding to the first phase of exercise and then reverse direction and travel in a second direction the respective fields corresponding to the second phase of exercise). As shown by FIG. 9, the actual performance of the intra-repetition exercise characteristics by the exerciser (1) substantially compare to the pre-established target performance of intra-repetition exercise characteristics for the first phase (4) of the exercise, the target and the actual indicia traveling in the same first direction at the substantially the same rate.

Figure 10:
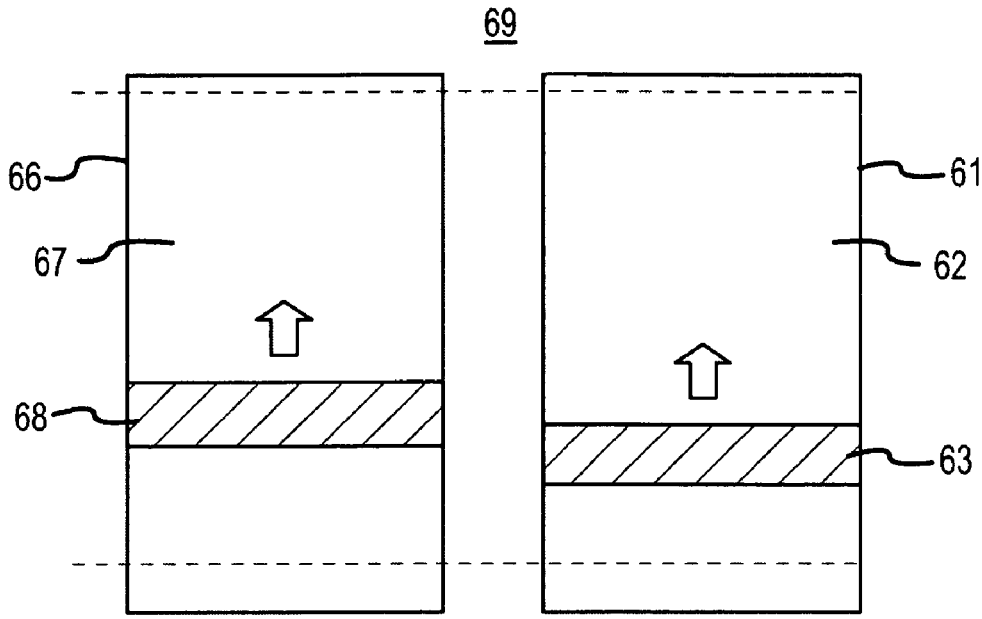
FIG. 10 shows an embodiment of the intra-repetition performance indicator image which indicates the actual performance of an intra-repetition exercise characteristic in the first phase of an exercise lags behind the pre-established target performance for the particular intra-repetition exercise characteristic.

As shown in FIG. 10, the actual performance of intra-repetition exercise characteristics by the exerciser (1) lag behind the pre-established target performance of the intra-repetition exercise characteristics for the first phase (4) of the exercise indicating that the exerciser (1) should alter exercise efforts to match the position of the actual performance indicia (63) to the position of the target indicia (68) within the respective indicator fields.

Figure 11:
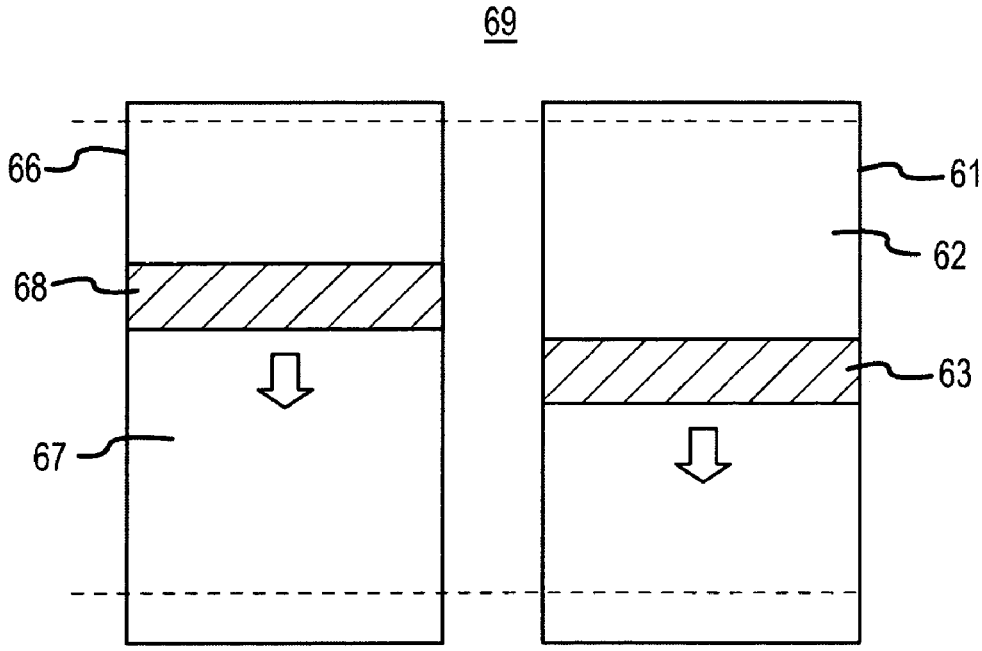
FIG. 11 shows an embodiment of the intra-repetition performance indicator image which indicates the actual performance of an intra-repetition exercise characteristic in the second phase of an exercise exceeding the pre-established target performance for the particular intra-repetition exercise characteristic.

As further shown in FIG. 11, the actual performance of intra-repetition exercise characteristics by the exerciser (1) exceeds the pre-established target performance of the intra-repetition exercise characteristics for second phase (5) of the exercise indicating that the exerciser (1) should alter exercise efforts to match the position of the actual indicia (63) to the position of the target indicia (68) in their respective fields.

While FIGS. 6-11, illustrate the use of intra-repetition indicators (61)(66) to provide sensorially perceivable indicia (63)(68) to inform the exerciser (1) (or another person (56)) of target performance and actual performance of the above-described intra-repetition exercise characteristics in the first phase (4) or in the second phase (5) of an exercise, or by comparison of the intra-repetition indicators (61)(66) allow the exerciser (1) to alter actual performance in the first phase (4) or the second phase (5) of an exercise to correspond with target performance of pre-established intra-repetition exercise characteristics, it is not intended that the invention be limited solely to these applications and embodiments of the intra-repetition application program can provide images configured to provide the exerciser (1) with indicia related to other intra-repetition characteristics such as: accuracy of an actual intra-repetition performance whether related to a rate function, a range function, force function; number of intra-repetition phases performed whether of the first phase (4) or the second phase (5); compliance with an external exercise performance standard (69)(which can be a component of the intra-repetition application program (24)) such as an exercise performance assessment, analysis, or reporting standard established by federal, state, or local law, rule or regulation or by an insurance business entity, medical business entity, physical fitness business entity, university, medical college, trainer, therapist, physician; or the like.

Again referring primarily to FIG. 6, the intra-repetition performance indicator module (82) of the exercise intra-repetition software application (24) can further generate an intra-repetition percentage completion indicator (58) which provides a percentage completion indicator field (59) in the generated at least one intra-repetition performance indicator image (55) which can be incrementally filled by a percentage completion indicia (60)(such as a bar or a percentage notation as shown in FIG. 6) in correspondence to the actual percent completion (61) of an exercise intra-repetition. Naturally, various other configurations of the intra-repetition percentage completion indicator (58) can be utilized including, as but one example, a notation of the actual percent completion (62) without more.

Figure 7:
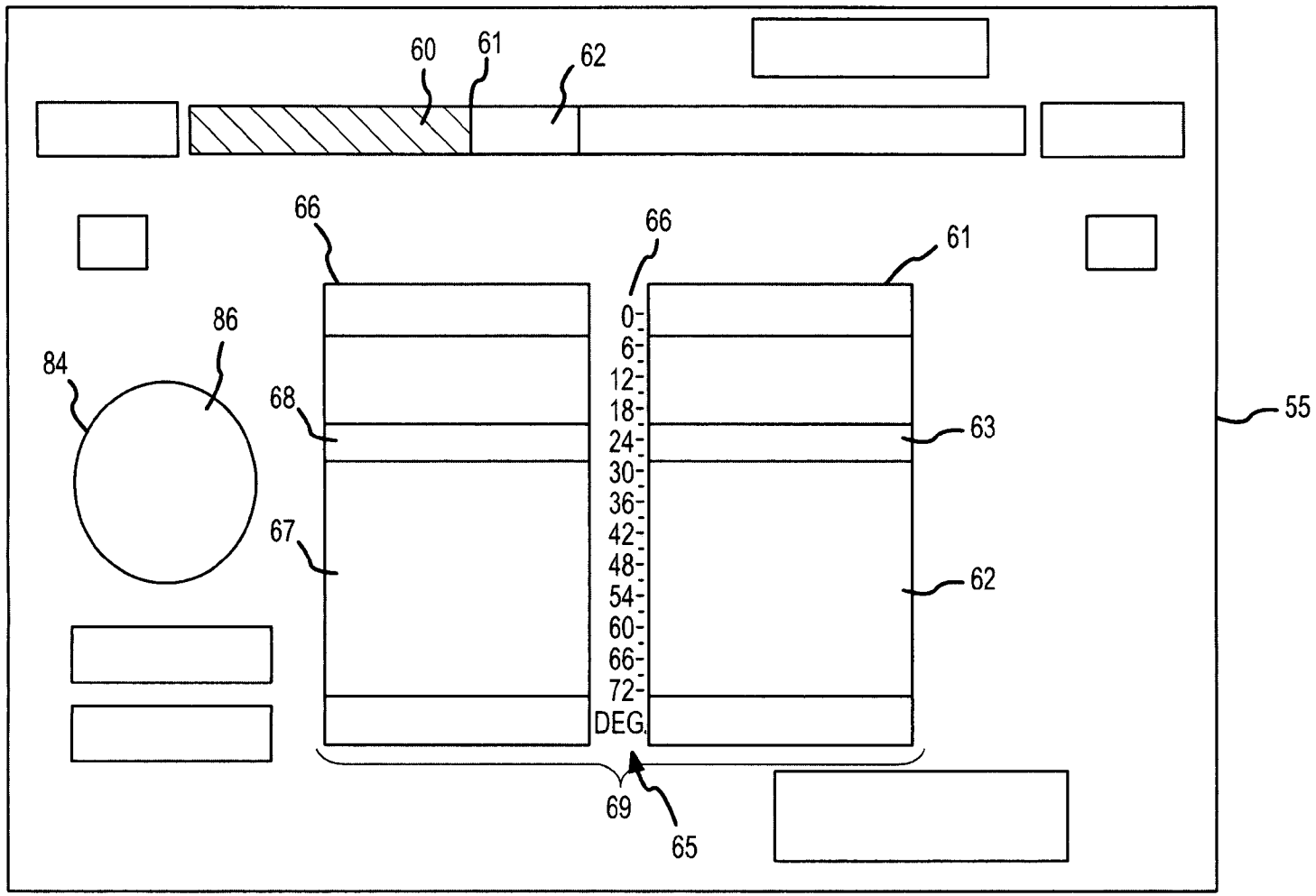

Now referring primarily to FIGS. 6 and 7, the intra-repetition performance indicator module (82) of the exercise intra-repetition software application (24) can further include a breath pacer (83) which can generate a breath condition image (84) which alternates between a breath in condition image (85) and a breath out condition image (86)(or other sensorially perceivable indicia) at a pace in correspondence to the pre-established target speed for performance of the first phase of the exercise and the second phase of the exercise. In certain embodiments of the invention, the breath condition image (85) can increase in area to provide the breath in condition image (85) and decrease in area to provide the breath out condition image (86). The increase in area can correspond with the duration of the first phase (4) of the exercise or a portion thereof and the decrease in area can correspond with the duration of the second phase (5) of the exercise, or portion thereof. Alternately, the breath condition image (84) can decrease in area to provide the breath in condition image (85) and increase in area to provide the breath out condition image (86). The decrease in area can correspond with the duration of the first phase (4) of the exercise or a portion thereof and the increase in area can correspond with the duration of the second phase (5) of the exercise or portion thereof. Importantly, the exerciser (1) has a sensorially perceivable indicia whether by sight, sound, touch, or otherwise which corresponds to a breath in condition and a breath out condition coupled to the pre-established target speed or pace at which the first phase (4) and the second phase (5) of the exercise alternate. Understandably, if exerciser's actual breath in and breath out fails to correspond to alternation of the breath in condition image (85) and the breath out condition image (86), the exerciser (1) alters breathing in and breathing out to correspond to the alternation of the breath in condition image (85) (or other sensorially perceivable indicia) and the breath out condition image (86).

Figure 12:
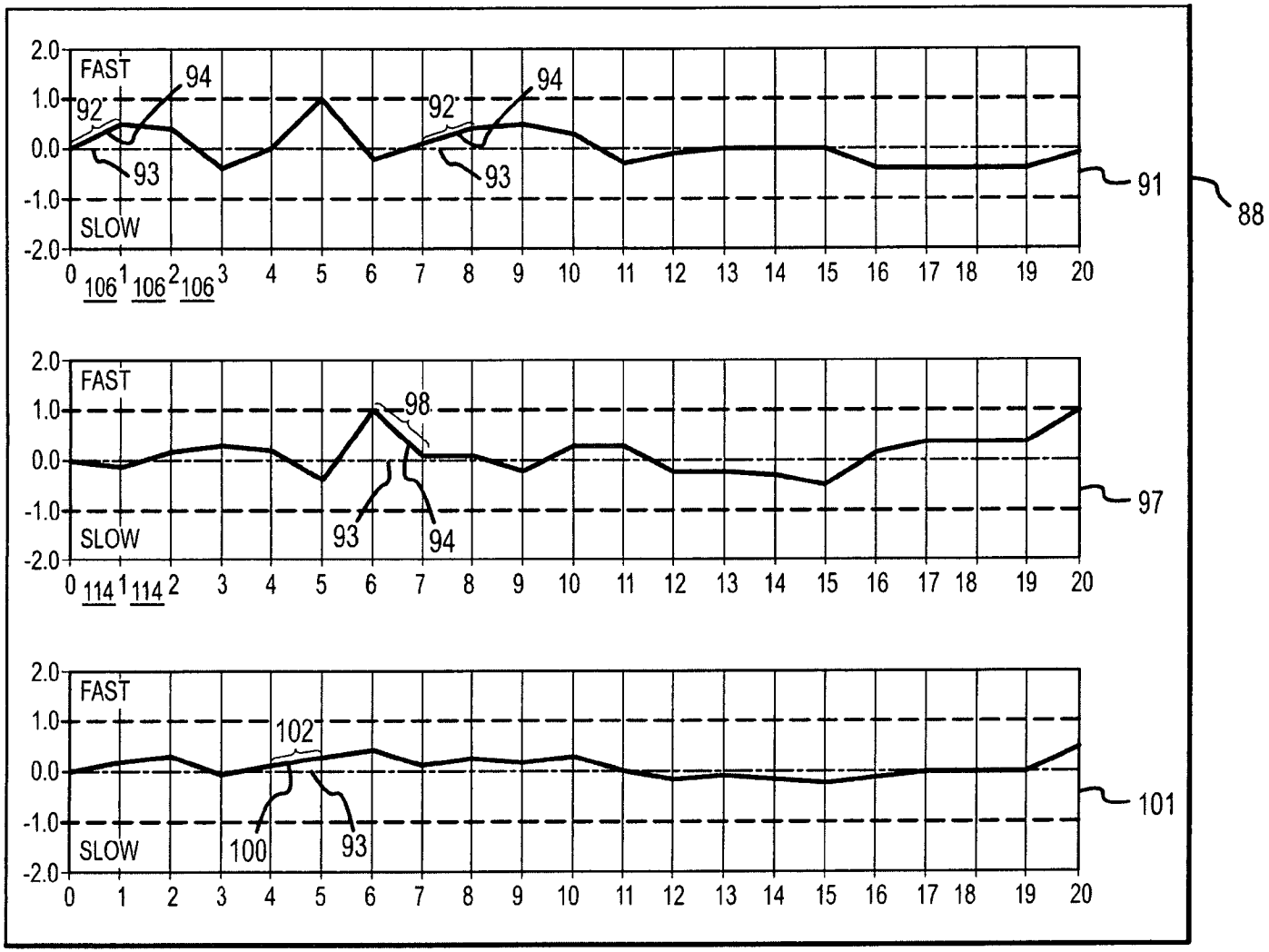
FIG. 12 shows an embodiment of a display which provides a first phase deviation image, a second phase deviation image, and average intra-repetition deviation image generated by an embodiment of an intra-repetition deviation indicator of the invention.

Now referring to FIG. 12, the intra-repetition performance indicator module (82) of the exercise intra-repetition software application (24) can further include an intra-repetition deviation indicator (87) which generates an intra-repetition deviation indicator image (88) and further provides a first phase deviation calculator (89) which compares the pre-established target performance of at least one intra-repetition exercise characteristic in the first phase (4) of said exercise to the actual performance of the at least one intra-repetition characteristic in the first phase (4) of said exercise to generate a first phase deviation value (90) for each of the at least one repetition of said exercise. As part of the intra-repetition deviation indicator image (88) the intra-repetition deviation indicator (87) generates a first phase deviation image (91) which includes a visually observable first phase deviation indicia (92) which corresponds to the first phase deviation value (90)(the example shown by FIG. 12 provides a first phase deviation value (90) updated throughout the first phase of the exercise to provide an intra-repetition graph as the first phase deviation indicia) for each performed intra-repetition first phase (4) of the exercise performed by the exerciser (1). The first phase deviation value (90) can be determined as the pre-established target performance value (93) of the intra-repetition characteristic for a duration of exercise within the first phase (4) of the exercise less the actual performance value (94) of the intra-repetition characteristic for the same duration of exercise within the first phase (4). As shown in FIG. 12, the actual performance of the intra-repetition characteristic for repetition 0-1 by the exerciser (1) was faster than the pre-established target performance of the intra-repetition characteristic for repetition 0-1 of the exercise in the first phase (4) as such the first phase deviation value (90) for the first phase of repetition 0-1 of exercise is positive relative to the pre-established target performance value (93).

Again referring to FIG. 12, the intra-repetition deviation indicator (87) which generates the intra-repetition deviation indicator image (88) can further provide a second phase deviation calculator (95) which compares the pre-established target performance of at least one intra-repetition exercise characteristic in the second phase (5) of the exercise to the actual performance of the at least one intra-repetition characteristic in the second phase (4) of the exercise to generate a second phase deviation value (96) for each repetition of exercise. As part of the intra-repetition deviation indicator image (88) the intra-repetition deviation indicator (87) generates a second phase deviation image (97) which includes a visually observable second phase deviation indicia (98) which corresponds to the second phase deviation value (96) for the each intra-repetition second phase (5) of the exercise performed by the exerciser (1). The second phase deviation value (96) can be determined as the pre-established target performance value (93) of intra-repetition characteristic for a duration of exercise within the second phase (5) of the exercise less the actual performance value (94) of the intra-repetition characteristic for the same duration of exercise within the second phase (5). As shown in FIG. 12, the actual performance of the intra-repetition characteristic by the exerciser (1) in the second phase (5) of repetition 6-7 was slower than the pre-established target performance (93) of the intra-repetition characteristic for the exercise in the second phase (5) of repetition 6-7, as such the second phase deviation value (96) for the second phase of the repetition 4-5 of exercise is negative relative to the pre-established target performance value (93).

Again referring to FIG. 12, the intra-repetition deviation indicator (87) which generates the intra-repetition deviation indicator image (88) can further provide a average intra-repetition deviation calculator (99) which sums the first phase deviation value (90) and the second phase deviation value (94) to generate an average intra-repetition deviation value (100). As part of the intra-repetition deviation indicator image (88) the intra-repetition deviation indicator (87) generates an average intra-repitition deviation image (101) which includes a visually observable average intra-repetition deviation indicia (102) which corresponds to the average intra-repetition value (100) for the each combined first phase (4) and second phase (5) of a repetition of exercise performed by the exerciser (1). As shown in FIG. 12, the actual performance of the intra-repetition characteristic by the exerciser (1) in the first phase (4) and second phase (5) of repetition 4-5 was on average faster than the pre-established target performance of the intra-repetition characteristic for the exercise in first phase (4) and the second phase (5) of repetition 4-5, as such the average intra-repetition value for the repetition 4-5 of exercise is positive relative to the pre-established target performance value (93).

Now referring to FIG. 13, which provides a flow chart of the stepwise functions performed by a non-limiting preferred embodiment of the intra-repetition application program (24) in practicing the invention, as above-described. In a first step (103) the intra-repetition performance indicator module (82) of the exercise intra-repetition software application (24) can be programmed with the pre-established target performance for at least one intra-repetition characteristic of an exercise to be performed and the intra-repetition performance indicator module (82) generates the at least one intra-repetition performance indicator image (55) which can displayed on the monitor (30) perceivable by the exerciser (1) or a second monitor (40) perceivable by a second person (56) such as a trainer or a therapist. The various indicator fields above-described, such as the target indicator field (67), the actual performance indicator field (62), the breath pacer (84) along with the associated units such as degree units, are configured by the intra-repetition performance indicator module (82) to correspond to the established travel range of movable portion (43) of the exercise device and configured to allow comparison of at least one pre-established target performance of the intra-repetition exercise characteristics and the actual performance of the intra-repetition exercise characteristic. In a second step (104), the computer (8) receives signals (45)(50)(53)(or other signals) to assess whether the exercise device (7) is established at the first location (47) of the first phase (4) of the exercise.

In a third step (105), the first phase (4) of the first repetition (106 of the exercise can be started or delayed a duration of time (see FIG. 12 graphically displaying a first repetition in the first phase), and in a fourth step (107) the intra-repetition application program (24) sets both the actual performance indicia (63) and the target indicia (68) at the first location position (71) in their respective fields (67)(62)(as shown for example in FIGS. 6 and 8). In a fifth step (108), the target indicator (68) begins travel in the target indicator field (67) corresponding to the pre-determined target performance of the one or more intra-repetition exercise characteristics of the first phase (4) of exercise (for example the pre-established intra-repetition direction of travel, speed, or rate)(as shown for example in FIGS. 7, 9 and 10). The breath pacer (84) can provide the breath in condition image (85) or the breath out condition image (86) pre-established for the first phase (4) of the exercise (as shown for example in FIG. 6).

In a sixth step (109), the computer (8) analyzes the actual location of the movable portion(s) (43) of the exercise device (7) and correspondingly generates travel of the actual performance indicia (63) in the actual performance indicator field (62)(as shown for example by FIGS. 6 and 9). In a seventh step, when the movable portion of the exercise device (7) reaches the end of the travel path (6) of the first phase (4) of the exercise, the computer (8) receives a signal (such as the second signal (50)) and the direction of the actual performance indicia (63) can alter direction in the actual performance field (62) to correspond to the direction of travel of the exercise device (7) in the second phase (5) of the exercise. Similarly, in the seventh step (109) the travel direction of the target indicia (68) can also be altered (77) to begin return to the first location position (71) at the pre-determined target performance of the intra-repetition exercise characteristic (such as the pre-established intra-repetition direction of travel, speed, or rate). The breath in condition image (85) or the breath out condition image (86) of the breath pacer (84) established for the first phase (4) of the exercise can be also be altered to the breath in condition image (85) or the breath out condition image (86) established for the second phase (5) of the exercise.

Regardless, as to whether the direction of travel of the target indicia (68) or the actual performance indicia (63) in their respective fields is altered, the travel of the target indicia (68), the travel of the location indicia (63), the direction of travel of the target indicia (68) and the direction of travel of the actual performance indicia (63), along with the breath in condition image (85), or breath out condition image (86) of the breath pacer (84) continue to be updated in correspondence to the pre-established target performance of the intra-repetition exercise characteristics programmed and the actual performance at which the exercise is performed in an eighth step (111).

In a ninth step (112), commencing with the end of travel by the exercise device (7) in the second phase (5) of the exercise it can be determined whether the intra-repetition application program (24) should terminate. If yes, then in a tenth step (113), both the actual performance indicator (63) and the target indicator (68) can be re-established at the first location position (71) position in the respective fields (62)(67). Alternately, if additional first phase repetitions (106) and additional second phase repetitions (114) of the exercise are to be performed, the intra-repetition application program (24) can repeat steps six (108) through step nine (112) to update travel of the target indicia (68) and the actual performance indicia (63), direction of travel of the target indicia (68) and the actual performance indicia (63) within their respective fields (62) (67) and alternation of the breath out condition and the breath out condition of the breath pacer.

In certain embodiments of the invention, a conventional machine and method for measuring strength of muscles as disclosed by U.S. Pat. No. 6,228,000 can be modified to be utilized with the invention herein described. The invention described herein by providing an interface between the conventional device shown in the issued patent and the computer (8) herein described to allow the signals from the conventional sensors shown (or from additional sensors such as the first sensor (42), the second sensor (51) or the third sensor (52), or all of them, or other additional sensors as above-described) to be applied to the exercise intra-repetition application program (24) to capture intra-repetition data, or allow use or comparison of pre determined intra-repetition characteristics, or to generate images perceivable by the exerciser (1) or other person (56) relating to intra-repetition characteristics whether pre-determined or actually performed.

As can be easily understood from the foregoing, the basic concepts of the present invention may be embodied in a variety of ways. The invention involves numerous and varied embodiments of an exercise intra-repetition assessment system and methods of making and using such exercise intra-repetition assessment system. As such, the particular embodiments or elements of the invention disclosed by the description or shown in the figures accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of an "exercise" should be understood to encompass disclosure of the act of "exercising" whether explicitly discussed or not and, conversely, were there effectively disclosure of the act of "exercising", such a disclosure should be understood to encompass disclosure of a "exercise" and even a "means for exercising." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

Thus, the applicant(s) should be understood to claim at least: i) each of the exercise intra-repetition assessment systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof or to obtain any benefit of reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below, if any, are intended describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A method of performing intra-repetition exercise, comprising the steps of:

a. engaging a part of an exerciser to an exercise device;

b. initiating operation of an intra-repetition performance indicator responsive to travel of said exercise device;

c. generating an intra-repetition performance indicator image which provides:

i. a target indicia which travels in a target indicator field in correspondence with a pre-established target speed of intra-repetition travel of said exercise device in a first phase of an exercise and in a second phase of said exercise; and ii. an actual performance indicia which travels within an actual performance indicator field in correspondence with actual speed of intra-repetition travel of said exercise device in said first phase of said exercise and in said second phase of said exercise in response to said exercise of said exerciser engaged to said exercise device;

d. generating travel of said target indicia within said target indicator field in correspondence with said pre-established target speed of intra-repetition-travel of said exercise device in said first phase of said exercise and in said second phase of said exercise;

e. generating travel of said actual performance indicia within said actual performance indicator field in correspondence with actual speed of intra-reptition travel of said exercise device in said first phase of said exercise and in said second phase of said exercise in response to said exercise of said exerciser engaged to said exercise device;

f. comparing travel of said actual performance indicia within said actual performance indicator field with travel of said target indicia within said target indicator field; and g. altering actual speed of intra-repetition travel of said exercise device in response to said exercise of said exerciser engaged to said exercise device when travel of said actual performance indicia within said actual performance indicator field fails to compare with travel of said target indicia within said target indicator field.

2. A method of performing intra-repetition exercise as described in claim 1, further comprising the steps of:

a. generating a first increment of travel of said target indicia within said target indicator field which corresponds to said pre-established target speed of intra-repetition travel of said exercise device of said first phase of said exercise; and b. generating a second increment of travel of said target indicia within said target indicator field which corresponds to said pre-established target speed of intra-repetition travel of said exercise device of said second phase of said exercise.

3. A method of performing intra-repetition exercise as described in claim 2, wherein said first increment of travel of said target indicia within said target indicator field has a first direction of travel which corresponds to said pre-established target speed of intra-repetition travel of said exercise device of said first phase of said exercise, and wherein said second increment of travel of said target indicia within said target indicator field has a second direction of travel which corresponds to said pre-established target speed of intra-repetition travel of said exercise device of said second phase of said exercise.

4. A method of performing intra-repetition exercise as described in claim 3, further comprising the steps of:

a. generating a first increment of travel of said actual performance indicia within said actual performance indicator field which corresponds to said actual speed of intra-repetition travel of said exercise device in response to said exercise of said exerciser engaged to said exercise device of said first phase of said exercise; and b. generating a second increment of travel of said actual performance indicia within said actual performance indicator field which corresponds to said actual speed of intra-repetition travel of said exercise device in response to said exercise of said exerciser engaged to said exercise device of said second phase of said exercise.

5. A method of performing intra-repetition exercise as described in claim 2, wherein said first increment of travel of said actual performance indicia within said actual performance indicator field has a first direction of travel which corresponds to said actual speed of intra-repetition travel of said exercise device in response to said exercise of said exerciser engaged to said exercised device of said first phase of said exercise, and wherein said second increment of travel of said actual target indicia within said actual performance indicator field has a second direction of travel which corresponds to said actual speed of intra-repetition travel of said exercise device in response to said exercise of said exerciser engaged to said exercise device of said second phase of said exercise.

6. A method of performing intra-repetition exercise as described in claim 1, further comprising the steps of:

a. comparing said pre-established target speed of intra-repetition travel of said exercise device in said first phase of said exercise to said actual speed of intra-repetition travel of said exercise device in response to said exercise of said exerciser engaged to said exercise device in said first phase of said exercise; and b. generating a first phase deviation value for said first phase of said exercise.

7. A method of performing intra-repetition exercise as described in claim 6, further comprising the step of generating a first phase deviation image which includes a visually observable first phase deviation indicia which corresponds to said first phase deviation value for said first phase of said exercise.

8. A method of performing intra-repetition exercise as described in claim 7, further comprising the steps of:

a. comparing said pre-established target speed of intra-repetition travel of said exercise in said second phase of said exercise to said actual speed of intra-repetition travel of said exercise device in response to said exercise of said exerciser engaged to said exercise device in said second phase of said exercise; and b. generating a second phase deviation value for said second phase of said exercise.

9. A method of performing intra-repetition exercise as described in claim 8, further comprising the step of generating a second phase deviation image which includes a visually observable second phase deviation indicia which corresponds to a second phase deviation value for said second phase of said exercise.

10. A method of performing intra-repetition exercise as described in claim 9, further comprising the step of generating an average intra-repetition deviation value based on one half of the a sum of the first phase deviation value and said second phase deviation value for each of at least one repetition of said exercise.

11. A method of performing intra-repetition exercise as described in claim 10, generating an average intra-repetition deviation image which includes a visually observable average intra-repetition deviation indicia which corresponds to said average intra-repetition deviation value for each of said at least one repetition of said exercise.

12. A method of performing intra-repetition exercise as described in claim 1, further comprising the steps of:

a. initiating operation of a breath pacer;

b. generating a breath condition image which alternates between a breath in condition image and a breath out condition image by operation of said breath pacer;

c. establishing a pace at which said breath condition image alternates between said breath in condition image and said breath out condition image;

d. coupling said pace at which said breath condition image alternates between said breath in condition image and said breath out condition image to alternation between said first phase of said exercise and said second phase of said exercise; and e. adjusting a breath in and a breath out while performing said exercise when breath in and breath out fails to correspond with said breath in condition image and said breath out condition image.

* * * * *